United States Patent [19]

Bishop

[11] Patent Number: 5,006,008

[45] Date of Patent: Apr. 9, 1991

[54] SECTIONAL HIGHWAY BARRIER WITH RESILIENT CYLINDRICAL INSERTS

[76] Inventor: Robert J. Bishop, 1083 Bloomfield Ave., West Caldwell, N.J. 07006

[21] Appl. No.: 509,209

[22] Filed: Apr. 16, 1990

[51] Int. Cl.[5] ..... E01F 13/00; E01F 15/00

[52] U.S. Cl. ..... 404/6; 404/10

[58] Field of Search ..... 404/6, 9, 10; 256/13.1; 40/612

[56] References Cited

U.S. PATENT DOCUMENTS

| | | | |
|---|---|---|---|
| 4,822,208 | 4/1989 | Ivey | 256/13.1 X |
| 4,854,767 | 8/1989 | Sasaki | 404/6 |
| 4,869,617 | 9/1989 | Chiodo | 404/6 |
| 4,925,333 | 5/1990 | Bishop | 404/6 |

*Primary Examiner*—William P. Neuder

*Attorney, Agent, or Firm*—Howard E. Thompson, Jr.

[57] ABSTRACT

A shock-absorbing and motorist warning highway barrier is provided comprising a plurality of elongated upstanding units adapted to be joined in end to end relation, each unit comprising an outwardly flared base and an upstanding central portion having interfitting protrusions at opposed ends thereof facilitating end to end coupling of adjacent units, opposed side surfaces of the upstanding portion having a plurality of transversely aligned and longitudinally spaced recesses to receive resilient cylindrical members in a manner to protrude substantially from such surfaces, the cylindrical members being insertable and removable through the top of the unit and being secured in place by a cover member having downward protrusions interfitting with the aligned recesses in said unit. In preferred adaptations each unit may have a sinusoidal contour in the longitudinal dimension incorporating two sine curves, and/or the recesses and cylindrical members mounted therein may be outwardly inclined about 5° to 10° from the vertical. To facilitate direction change in aligning units to form a highway barrier, connecting units are provided having closely spaced angularly disposed coupling end portions, and providing at one side thereof one recess to receive a single resilient cylindrical member. The main barrier units and connecting units may be molded concrete, but are preferably formed as thin-walled plastic shells to be filled with water, sand or cement at the time of installation. The cylindrical members can be solid resilient members or thin-walled plastic members filled with compressed air, liquid or sand.

20 Claims, 3 Drawing Sheets

SECTIONAL HIGHWAY BARRIER WITH RESILIENT CYLINDRICAL INSERTS

This invention relates to sectional highway barriers for use as highway dividers and/or protective screens along construction sites, in which each section comprises an elongated flared base joining an upstanding portion having longitudinally spaced recesses for the reception of resilient tubular members which protrude from surfaces of the upstanding portion to provide shock absorbing and motorist warning characteristics to the assemblage. The barrier sections, which are detachably coupled in end-to-end relation, and readily movable from place to place when uncoupled, are particularly intended for temporary use to provide lane changes and protective screenings along highway construction sites.

BACKGROUND OF THE INVENTION

It has long been the practice in providing highway dividers and protective screenings along construction sites to employ elongated concrete members, having a relatively upstanding portion and flared supporting base, aligned in end-to-end relation to form an essentially continuous barrier in the area needed. The preformed sections, generally fabricated from concrete and about sixteen feet in length, are extremely heavy, requiring special equipment for transport from location to location. While quite durable as both highway dividers and screens for construction sites, these sectional highway barriers leave much to be desired in many respects. While relatively indestructible when installed as highway divider, such barriers, when used as protective screening along construction sites, are easily damaged when being moved from place to place, and frequently must be discarded and replaced after five or six moves to different construction locations.

Highway barriers of the type described, while effectively guiding motorists in high speed travel along busy highways can cause serious damage to vehicles coming in contact with them, and they have been the cause of many serious and sometimes fatal accidents due to loss of control of moving vehicles when contacting the barriers. Furthermore, the relatively narrow profile of the barrier ends make them difficult to see in various weather conditions, and many accidents have been experienced involving head-on impact with the barrier ends.

It follows from the foregoing that both from the standpoint of installation and maintenance, and the standpoint of motorist safety, there is need for improvement in ways of providing highway barriers and protective screens for highway construction sites.

An approach to solving this problem has been disclosed and claimed in my pending patent application, Ser. No. 386,984 filed July 31, 1989. As there disclosed easy portability is provided by employing relatively short units, joined in end-to-end relation, with each unit made up of four vertically aligned members having offsets in abutting surfaces to collectively form semi spherical recesses for receiving spherical plastic bumper members which protrude from the side surfaces of the assemblage. The recesses and protruding spheres are then arranged in three rows extending longitudinally of each side of the unit, suitably in a staggered 3-4-3 or 4-3-4 arrangement.

The protruding plastic spheres provide the dual advantage of minimizing vehicle damage through a glancing contact with the barrier, and providing the motorist with an audible signal of glancing contact in time to steer away, and avoid more serious contact. Unfortunately these advantages are not equally shared by all motorists due to the wide variation in the side profile of different vehicles, and the resulting variation in the vehicle to barrier spacing which can initiate the audible warning contact. Thus even this improved type of barrier leaves something to be desired.

THE INVENTION

It has now been found, in accordance with the present invention, a further improvement in damage minimizing and motorist warning highway barriers can be attained by employing, in place of the spherical plastic bumpers of Ser. No. 386,984, a plurality of longitudinally spaced and vertically oriented plastic cylinders supported to protrude from opposed surfaces of the barriers. While this loses the unique portability of the built-up structure disclosed in Ser. No. 386,954, a significant degree of portability is attained by providing in the base of each barrier unit cutouts of a size and spacing to be readily engaged by a conventional fork-lift, whereby a skillful fork-lift operator can easily move about the barrier sections, as needed.

Regarded in certain of its broader aspects, the barrier of the present invention comprises a plurality of elongated upstanding units adapted to be joined in end-to-end relation, each unit comprising an outwardly flared base and an upstanding central portion having interfitting protrusions at opposed ends thereof facilitating end to end coupling of adjacent units, opposed side surfaces of the upstanding portion having a plurality of transversely aligned and longitudinally spaced recesses to receive resilient cylindrical members in a manner to protrude substantially from such surfaces, the cylindrical members being insertable and removable through the top of the unit and being secured in place by a cover member having downward protrusions interfitting with the aligned recesses in said unit. In preferred adaptations each unit may have a sinusoidal contour in the longitudinal dimension incorporating two sine curves, and/or the recesses and cylindrical members mounted therein may be outwardly inclined at the top about 5° to 10° from the vertical.

To facilitate direction change in aligning units to form a highway barrier, connecting units are provided having closely spaced angularly disposed coupling end portions, and providing at one side thereof one recess to receive a single resilient cylindrical member. The main barrier units and connecting units may be fashioned from molded concrete but are preferably formed as thin-walled plastic members filled with compressed air, liquid or sand.

The barrier units are suitably about 80" (6' 8") in length, about 20" to 24" wide at the base, and about 40" to 42h" high. The cylindrical plastic units are suitably about 24" long and 7½" in diameter, with eight such cylindrical inserts being equally spaced along each side of the unit, and protruding from the side surface about 1" to 1½". The cylindrical member should fit loosely in the unit recesses so that the shock of impact, particularly from a glancing angle, can be absorbed both by resilience and by rotation.

The lower ends of plastic cylinders are positioned approximately at the top of the base taper, about 10"

above ground level, thus providing a zone extending from 10" to 34" above ground level in which protruding resilient plastic will be first contacted by a glancing vehicle. With this large a zone the assemblage will react similarly to glancing contact by most conventional vehicles (excluding large trucks and busses), regardless of side profile of the vehicle, to produce an audible and physical (vibrational) signal as a vehicle comes close enough to contact the barrier. In most instances this signal should alert a driver to steer away from the barrier and avoid more serious contact.

With the 80" barrier units each having 8 cylindrical members, a vehicle traveling 45 mph or 66 feet per second would generate an audible and physical signal through glancing contact at a frequency of about 80 impulses per second. A somewhat lower frequency could provide a more effective warning signal.

To accomplish this the barrier units are preferably formed with a sinusoidal curve in the longitudinal direction having two cycles per unit length and an amplitude of about 3" to 4" between convex and concave limits of the curve. With such a configuration, as shown in the drawings, alternating pairs of cylindrical members will be contacted, missed, contacted, etc. by a glancing vehicle. This means that our 45 mph vehicle will generate audible and physical signals at a frequency of about 20, double impact, impulses per second, a frequency considered to be highly effective for warning purposes.

Quite apart from the warning signal advantage, the provision of sinusoidally curved contour in the barrier units could, particularly when the units are plastic shells filled with water or sand, provide enhanced absorption of a greater than glancing impact. This would be due to an added element of overall resilience due to the longitudinal curves in the unit when compared with the relative rigidity of a straight unit.

It should be noted, however, that even in a straight unit the advantage of a lower frequency warning signal can be achieved by providing two spaced cylindrical members, or even a single cylindrical member, in each unit of slightly greater diameter, and having a greater degree of protrusion from the surface, than the other cylindrical members.

One of the major problems with highway barriers, particularly when struck a glancing blow at high speed, is the tendency of vehicles to try to "climb" the barrier, a tendency that is accentuated if the vehicle tires engage the flared supporting base. In order to minimize this problem, a preferred adaptation of the present invention has an upstanding portion which is slightly wider at the top than at the point of juncture with the base, to dispose the protruding cylindrical members at an angle of about 5° to 10° from the vertical.

Such a construction has the dual advantage of providing a slightly earlier warning signal to the motorist, so that he can steer away before a tire contacts the flared base, and also tending to resist any "climbing" action by reason of the outward inclination of the cylindrical members and supporting structure.

It is frequently desirable, particularly at the end of a construction site to provide barrier extensions at an angle to the traffic lane, both as a guide to motorists and as added protection for workmen and equipment involved in the construction. For this purpose I employ connector units of short longitudinal dimension, with ends and associated coupling means at an appropriate angle, and with a recess on the outer (wider) surface to receive a single cylindrical member. A versatile angularity is 15°, as multiples of the connecting unit can provide useful 30°, 45°, etc. offsets in the barrier assemblage It could also be desirable to provide a standard 45° connector unit, two of which collectively would provide a right angle orientation of the barrier assemblage. Such a 45° unit would carry two or three cylindrical members in its outer surface.

The barrier unit and connector units are provided with flat plastic covers of generally conformed contour having on the underside thereof projections formed to freely enter the recesses receiving the cylindrical members. End portion of the barrier unit, connector unit, and cover member will be provided with vertically aligned and interfitting protrusion: with vertically aligned apertures or passages to receive elongated metallic pins. Thus after applying the cover and inserting the pin, an assemblage of barrier units and connector units becomes, in effect, a unitary barrier assemblage.

The barrier unit and angled connector units can, if desired, be fashioned from molded concrete; but a preferable approach is to fashion these components from polyethyline or other plastic material to provide shells, open at the top, and having a wall thickness of about ¼". Such plastic shells would then be filled with water, sand, or even cement at the location of initial installation. The filled unit could thereafter be moved about by fork-lift while remaining filled. Alternatively, when the shells are filled with water or sand, the filling material can be removed before moving the barrier unit.

The cylindrical members can be molded from suitably resilient material, but are preferably formed as plastic shells with a wall thickness of ¼", to be filled with compressed air, water or sand. These cylindrical members should also be characterized as to color, so as to be strikingly visible under both daytime or nightime conditions. Such color characterization can be incorporated in the structural material, or applied as a coating, and should preferably have enhanced light-reflecting properties. As thus color characterized the cylindrical members provide a visual warning to the motorist, supplementing the earlier mentioned audible and physical warning resulting from glancing contact with cylindrical members.

The highway barriers as above described, having protruding resilient cylinders spaced along both longitudinal surfaces, are equally useful as highway dividers and construction site screens. It will be apparent, however, that resilience in the tubular members serves no useful purpose at the workmen's side of a construction site screen. From the standpoint of providing added weight to the barrier units when used as construction site screens, it could be advantageous to substitute at the workmen's side of an assemblage, cylindrical members of molded concrete.

It could even be advantageous, in barriers intended only for use as construction site screens, to fashion the barrier units with only one side surface supporting cylindrical inserts, and the other side surface being formed as a smooth surface, containing no cylinder receiving recesses. Such a modification should significantly reduce the production and maintenance costs per unit, but sacrifices the versatility of alternative uses of the device as earlier described.

Novel features of the improved highway barrier of the present invention will be more fully understood from a continuation of the following description having reference to the accompanying drawings in which the various parts thereof have been identified by suitable reference characters in the several views and in which.

Figure 1:
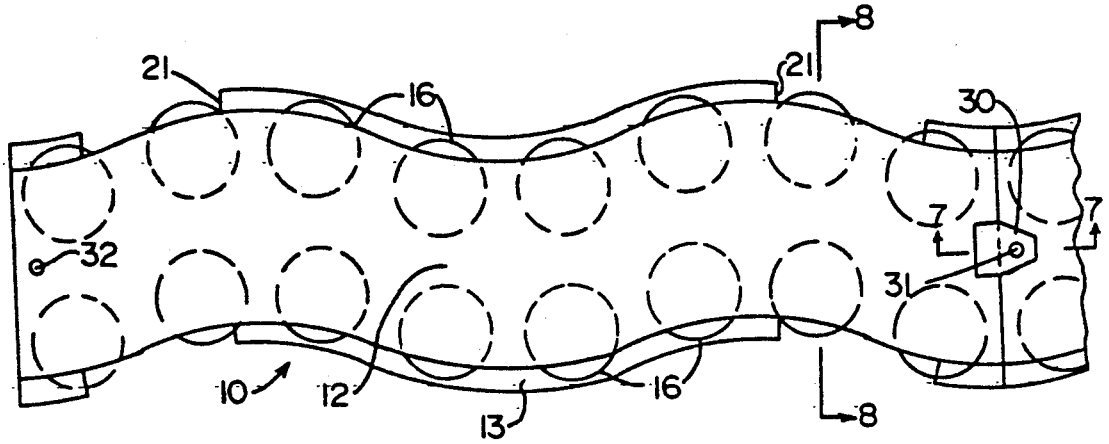
FIG. 1 is a top view of one highway barrier unit, including its cover as associated with a portion of an adjacent unit.
Figure 2:
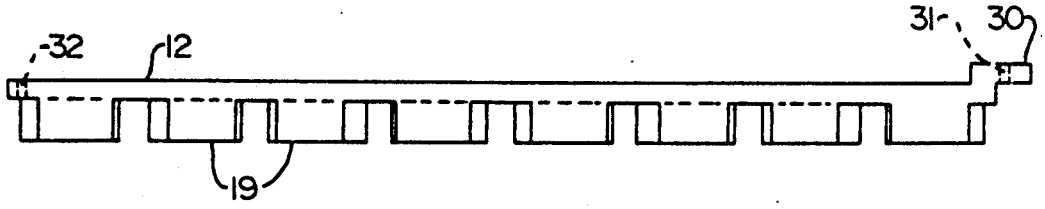
FIG. 2 is a side view of the unit cover detached
Figure 3:
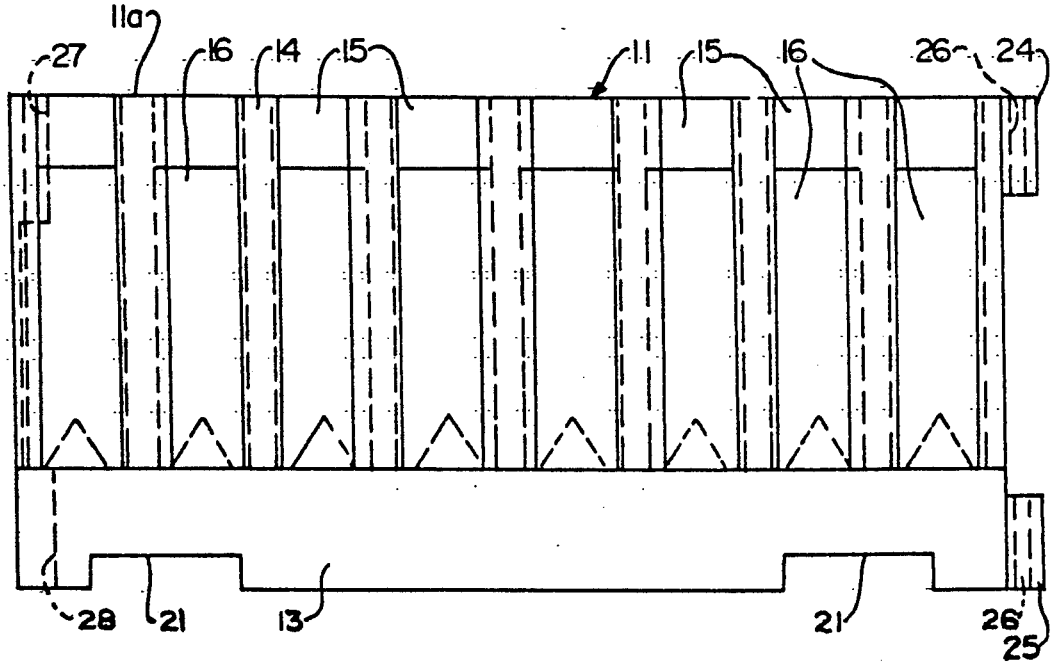
FIG. 3 is a side elevation view of the unit with cover removed.

As shown in FIGS. 1 to 7 and 9 of the drawing, the barrier unit 10 of the present invention comprises a main body part 11 having flared base 13 and upstanding central portion 14 having at opposed surfaces thereof longitudinally spaced and vertically oriented semi-cylindrical recesses 15 for receiving cylindrical inserts 16. Bottom walls of the recesses 15 are provided with conical upward extensions 17 interfitting with conical depression 18 at the bottom of the cylindrical inserts 16 serving to rotatably support the inserts 16 in the recesses 15.

As shown in the drawing, the inserts 16 are somewhat shorter than the recesses 15, and the cover 12 has a plurality of protrusions 19 at its lower surface, as arranged in size and number to interfit with the recesses 15 and partially filled space above the cylindrical inserts 16.

Figure 4:
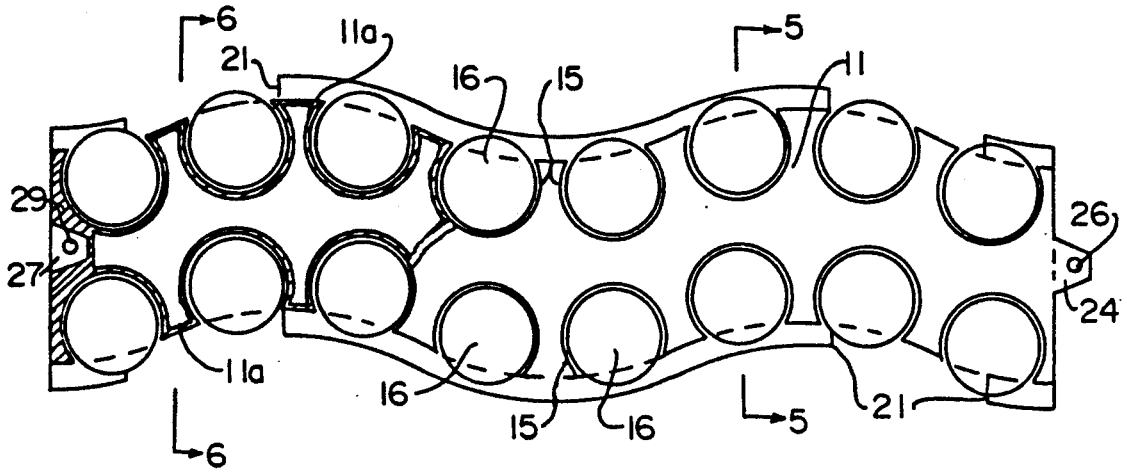
FIG. 4 is a top view of the unit as shown in FIG. 3.
Figure 5:
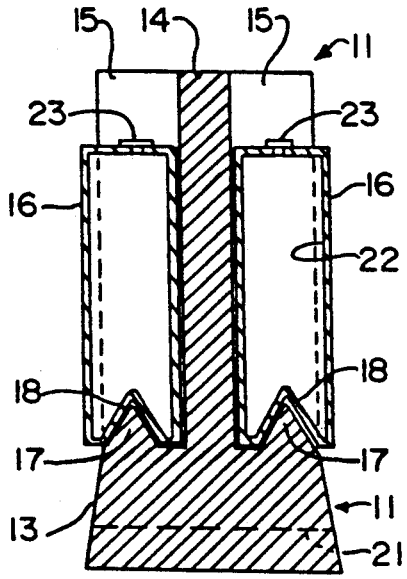
FIG. 5 is a sectional view taken substantially on the line 5—5 of FIG. 4.

The body portion 11 can be molded from concrete or other heavy dense material as illustrated in the right hand portion of FIG. 4 and in FIG. 5. Alternatively the body portion 11 can be fashioned as a hollow shell 11*a*, as illustrated at the left portion of FIG. 4 and in FIG. 7, which is open at the top and adapted to be substantially filled as indicated in 20 in FIG. 6, with water, sand or even concrete, if desired. Except for the open top, the shell 11*a*, which is formed of polyethylene or other suitable plastic, having a thickness of about ¼", and intended to be filled with compressed air, liquid or deformable solid, such as sand. The cylindrical shells 22 will be provided with top closures diagramatically indicated at 23 in FIG. 5 of a type appropriate for the filling material to be used.

It should be noted in this connection that the filled cylindrical shells 22 are intended to remain resiliently compressible in varying weather conditions. Thus, a water filling should include anti-freeze to prevent solidification at low temperatures, and a sand filling should be dry sand which will remain free flowing at low temperatures.

Figure 7:
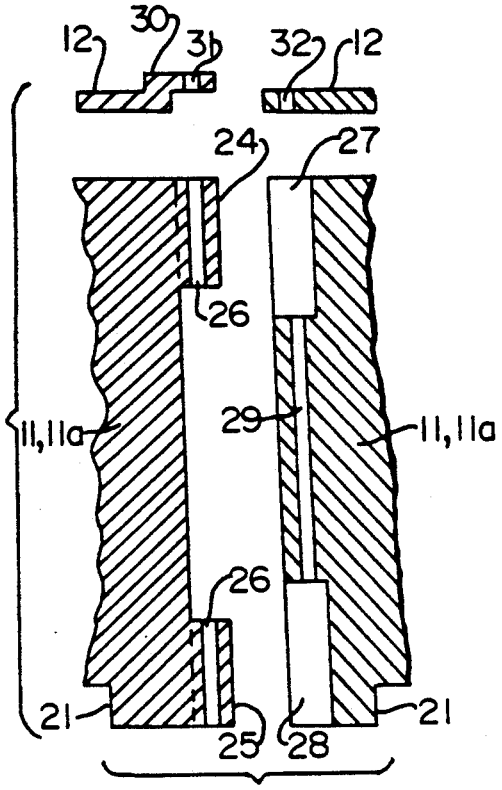
FIG. 7 is a doubly exploded sectional view of the unit coupling portion taken substantially on the line 7—7 of FIG. 1.

As shown in FIGS. 1 to 4, and exploded view of FIG. 7 opposed ends of the body portion 11, 11*a* and cover 12 are provided with interfitting means for joining barrier units in end-to-end relation. This interfitting structure, as clearly shown in FIG. 7, involves upper and lower protruding lugs 24, 25 with aligned pin receiving passages 26 interfitting with top and bottom recesses 27, 28 at the other end of the body portion, and the body portion between the recesses 27, 28 having a pin receiving passage 29 for alignment with the passages 26.

It will be noted that the vertical dimensions of the recesses 27 and 28 are somewhat larger than the vertical dimensions of the protruding lugs 24, 25 in order to permit relative vertical movement between parts as being aligned for engagement by a pin (not shown) passing downwardly through the passages 26-29-26. This allowance for vertical relative movement of the parts is intended to accomodate the vertical movement inherent in the use of a fork-lift to assemble and disassemble successive units on a barrier assembly.

As further illustrated in FIG. 7, the cover 12 has an offset lug 30 with aperture 31 adapted to align with the pin passages 26, and the other end of the cover 12 has an aperture 32 adapted to align with the pin passage 29. Thus, as a final assembly step, the pin which is suitably a headed steel rod about 1" in diameter, is passed through said aligned apertures and passages 31-32-26-29-26. The plurality of units thus secured together in end-to-end relation provide, in effect, a unitary highway barrier of any desired length.

Figure 9:
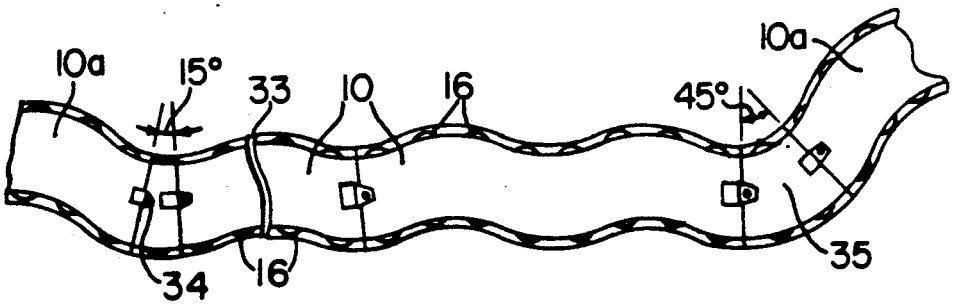
FIG. 9 is a longitudinally shortened top view of a plurality of units assembled as a highway barrier, and indicating special treatments of the barrier ends.

The illustration in FIG. 9 is a plan view of a highway barrier illustrating aligned units 10 with the break at 33 indicating indefinite shortening of the straight section joining end units 10*a* by connector unit 34, shown as providing an angle adjustment of 15°, and connector unit 35 shown as providing an angle adjustment of 45°. It will be understood that connector units can be provided to give various angular adjustments as needed in special situations; but it is considered that as standard equipment, connector units providing the 15° and 45° adjustment, and suitable multiples thereof, provide the versatility needed in most situations.

The connector units 34, 35 will have cross-section generally similar to FIG. 5 but without any recesses 15 or cylindrical inserts 16 in the concave portion thereof. The number of recesses 15 and cylindrical inserts 16 employed at the convex surface will depend upon the angular adjustments being provided; and as illustrated in FIG. 9 has a single cylindrical member 16 as appropriate for a 15° connector, whereas two cylindrical members 16 will be appropriate in a 45° connector.

To better visualize the size of the highway barrier units as illustrated in the drawing, the body portions 11, 11*a* is 80" long (6 ' 8") and about 40" high, with the cover 12 adding an additional inch The cylindrical members 16 are 7½" in diameter and about 24" long, and are elevated from the supporting surface about 10". The cylindrical members protrude from the side surfaces of the body part 11 about 1½, and it should be noted that eight cylindrical members are uniformly spaced longitudinally of the body part provides a zone extending 10" to 34" above the supporting surface in which glancing contact by parts of a moving vehicle will be possible without causing appreciable damage due to the resilience of the cylindrical members and their protrusion from the supporting body. At the same time, however, such glancing contact with the cylindrical members will produce both audible and physical (vibrational) signals to the motorist that he should steer away from the barrier to avoid more serious contact. If the units (body section and cover) were fashioned in straight or linear form (not illustrated, but readily visualized) a glancing contact with the barrier by a vehicle traveling 45 mph would be generating audible and physical warning signals at a frequency of about 80 impulses per second. It is considered, however, that a somewhat lower frequency would provide a more effective warning signal; and this has been achieved by providing in the body part and cover making up the unit a sinusoidally curved contour extending longitudinally thereof, having two cycles per unit length and an amplitude of about 4" between convex and concave limits of the curve. With this configuration, particularly as shown in FIG. 9, a glancing vehicle will alternately contact two, miss two, contact two, miss two, etc. of the protruding cylindrical members. This means that the 45 mph vehicle will generate audible and physical signals at a frequency of about 20 double impact impulses per second, a frequency considered to be highly effective for warning purposes.

The body portion of the unit has been earlier described as comprising either a solid molded member 11, or a hollow plastic shell 11*a*, to be filled with water or sand. The latter type construction is considered preferable from the standpoint of better absorbing the impact of greater than glancing vehicle contacts with the barrier. This is accounted for by a combination of the deformability of the plastic shell and the rearrangement possible with the liquid or sand filling. This advantage of improved impact absorption is believed to be enhanced by the sinusoidally curved contour above described because this adds an element of longitudinal deformability in the plastic shell which is not shared by a straight or linear construction of the shell.

Figure 6:
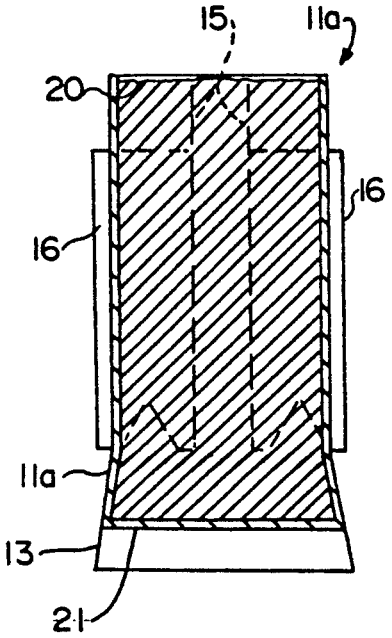
FIG. 6 is a sectional view taken substantially on line 6—6 on FIG. 4.

While the highway barrier unit as shown in FIGS. 5 and 6 have vertically oriented cylindrical members with the cylindrical members substantially protruding from side surfaces of the barrier can minimize accidents through the audible and physical warning signals generated by a glancing contact, this structure provides no way of limiting the tendency of vehicles to "climb" barriers in the event of more serious contact. As a means of overcoming this problem I have shown in FIG. 8 a modified form of construction in which the body portion lid is somewhat wider at the top 11*b* than at its juncture with the flared base so as to dispose recesses 15 and cylindrical members 16 supported therein at a slight angle from the vertical. While an angularity of approximately 10° has been shown in FIG. 8, it is considered that a preferred angularity would fall within the range of 5° to 10°.

With this modification the cover 12*a* will be slightly modified to incorporate angled projections 19*a* which are out off on their inner surfaces 19*b* to permit vertical insertion into the angled recesses 15. Note also that in FIG. 7 the cylindrical members 16 extend somewhat higher in the recesses 15 in order to protrude laterally beyond the top 11*d* of the body portion.

Figure 8:
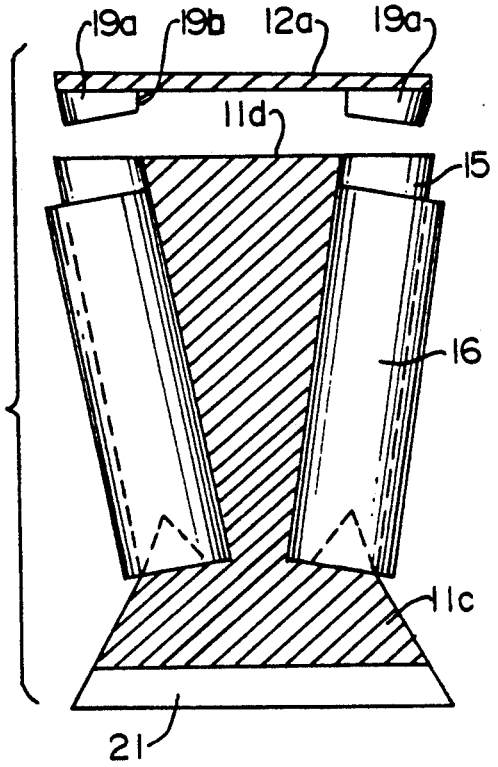
FIG. 8 is an exploded sectional view taken substantially on the line 8—8 of FIG. 1, and illustrating a modified form of construction.

Except for the changes above described, the FIG. 8 modification will be fashioned in the manner described in connection with FIGS. 1 to 8 and FIG. 9; and a preferred adaptation of the invention will incorporate both the sinusoidally curved unit contour and the inclined disposition of the cylindrical members 16.

In the various adaptations of the invention as above described, it is intended for the cylindrical insert members to be characterized as to color so as to make them uniquely visible in both daytime and nighttime conditions. This can be accomplished by incorporating proper pigment or coloring agent in the material from which the cylindrical members are fabricated, or by applying adherent coating to the surfaces of the cylindrical members, in which event the coating material would carry the pigment or coloring agent. In either instance the pigment or coloring agent should be one having high light reflecting properties, whereby the headlights of passing vehicles will provide enhanced nighttime visibility.

Various changes and modifications in the improved highway barrier herein disclosed may occur to those skilled in the art; and to the extent that such changes and modifications are embraced by the appended claims, it is to be understood that they constitute part of the present invention.

I claim:

1. A shock-absorbing and motorist warning highway barrier comprising a plurality of elongated upstanding units adapted to be joined in end-to-end relation, each unit comprising an outwardly flared base and an upstanding central portion having interfitting protrusions at opposed ends thereof facilitating end-to-end coupling of adjacent units, opposed side surfaces of the upstanding portion having a plurality of transversely aligned and longitudinally spaced recesses to receive resilient cylindrical members in a manner to protrude substantially from such surfaces, the cylindrical members being insertable and removable through the top of the unit and being secured in place by a cover member having downward protrusions interfitting with the aligned recesses in said unit.

2. A highway barrier as defined in claim 1, wherein the resilient cylindrical members are about 24" long with the lower ends being about 10" above the unit support surface, thereby providing a vehicle impact zone extending about 10" to 34" above the unit support surface.

3. A highway barrier as defined in claim 1, wherein the base and upstanding structure with cylinder receiving recesses are fashioned from heavy molded solid material.

4. A highway barrier as defined in claim 3, wherein the molded solid material is concrete.

5. A highway barrier as defined in claim 1, wherein the base and upstanding structure with cylinder receiving recesses are fashioned as a shell of plastic material, about ¼" thick, which is open at the top and adapted to be filled with heavy material at the site of barrier use.

6. A highway barrier as defined in claim 5, wherein the shell is filled with water which will contain antifreeze when intended for low-temperature use.

7. A highway barrier as defined in claim 5, wherein the shell is filled with sand.

8. A highway barrier as defined in claim 5, wherein the shell is filled with concrete.

9. A highway barrier as defined in claim 1, wherein the resilient cylindrical members are disposed vertically, with those on opposed sides of the unit being parallel to each other.

10. A highway barrier as defined in claim 1, wherein the resilient cylindrical members are disposed at uniform angles; in the range of 5° to 10° from the vertical, whereby the cylindrical members at opposed sides of the unit are more widely spaced at their upper ends than at their lower ends.

11. A highway barrier as defined in claim 1, wherein the longitudinal dimension of said unit is fashioned with a two cycle sinusoidal curve having an amplitude between convex and concave portions thereof of about 3" to 4".

12. A highway barrier as defined in claim 11, wherein the cover member has a sinusoidally curved contour matching that of the base.

13. A highway barrier as defined in claim 1, wherein the cylindrical members are fashioned from solid resilient material.

14. A highway barrier as defined in claim 1, wherein the cylindrical members are fashioned as hollow plastic shells about ¼" thick and filled with material which maintains resilient characteristics.

15. A highway barrier as defined in claim 14, wherein the shells are filled with compressed air.

16. A highway barrier as defined in claim 14, wherein the shells are filled with water containing anti-freeze.

17. A highway barrier as defined in claim 14, wherein the shells are filled with sand.

18. A highway barrier as defined in claim 1, adapted for use exclusively as a construction site screen, wherein resilient cylindrical members at the construction site are replaced with cylinders of molded concrete.

19. A. highway barrier as defined in claim 1, wherein the bottom of the base is provided with two undercuts of a size and spacing to permit ready engagement by a conventional fork-lift.

20. A highway barrier as defined in claim 19, wherein the interfitting protrusion at opposed ends of said unit include lugs on one end registering with recesses on the other end, and the vertical dimension of said recesses being sufficiently greater than that of said lugs to enable relative vertical movement of the interfitting parts as being moved by a fork-lift.

* * * * *